US007353640B2

(12) United States Patent
Stutler

(10) Patent No.: US 7,353,640 B2
(45) Date of Patent: Apr. 8, 2008

(54) FRESH MASONRY WALL PROTECTION DEVICE AND METHOD FOR RAPIDLY PROTECTING A NEWLY LAID MASONRY WALL

(76) Inventor: Mark Stutler, Rt. 3, Box 150E, Hurricane, WV (US) 25526

( * ) Notice: Subject to any disclaimer, the term of this patent is extended or adjusted under 35 U.S.C. 154(b) by 1107 days.

(21) Appl. No.: 10/081,156

(22) Filed: Feb. 25, 2002

(65) Prior Publication Data

US 2002/0124503 A1 Sep. 12, 2002

Related U.S. Application Data

(60) Provisional application No. 60/271,536, filed on Feb. 27, 2001.

(51) Int. Cl.
*E04B 1/00* (2006.01)

(52) U.S. Cl. ..... 52/100; 52/3; 52/300; 52/105; 52/DIG. 12

(58) Field of Classification Search ..... 52/3, 52/300, 58, 100, 105, 716.1, 716.2, DIG. 12
See application file for complete search history.

(56) References Cited

U.S. PATENT DOCUMENTS

| | | | | |
|---|---|---|---|---|
| 370,437 | A | 9/1887 | Wright | |
| 2,111,634 | A * | 3/1938 | Kotrbaty | |
| 2,232,905 | A | 2/1941 | Dyer | |
| 2,281,092 | A | 4/1942 | Andrews et al. | |
| 2,975,561 | A | 3/1961 | Branham | |
| 3,094,197 | A * | 6/1963 | Attwood | 52/100 |
| 3,109,260 | A | 11/1963 | De Cesare | |
| 3,284,971 | A * | 11/1966 | Attwood | 52/100 |
| 3,802,140 | A | 4/1974 | Hickman | |
| 3,862,531 | A | 1/1975 | Attaway et al. | |
| 3,872,633 | A | 3/1975 | Altosaar et al. | |
| 3,915,328 | A | 10/1975 | Hawes et al. | |
| 4,000,597 | A | 1/1977 | Burton | |
| 4,543,758 | A | 10/1985 | Lane | |
| 4,768,320 | A * | 9/1988 | Weller | 52/211 |
| 4,789,138 | A | 12/1988 | Acton | |
| 5,280,692 | A * | 1/1994 | Patey | 52/716.2 |
| 5,479,750 | A * | 1/1996 | Carlberg | 52/300 |
| 5,772,185 | A | 6/1998 | Pulsipher | |
| 5,950,680 | A * | 9/1999 | Randall | 52/301 X |
| 6,199,333 | B1 * | 3/2001 | Viduka | 52/300 |
| 6,216,408 | B1 * | 4/2001 | Davidson | 52/300 |
| D447,575 | S * | 9/2001 | Shaw | D25/121 |
| 6,505,449 | B1 * | 1/2003 | Gregori | 52/300 X |

* cited by examiner

*Primary Examiner*—Robert Canfield
(74) *Attorney, Agent, or Firm*—Jim Zegeer

(57) ABSTRACT

A fresh masonry wall protection device and method for rapidly protecting a newly laid block or brick wall from inclement weather. A thin plastic channel element has a top panel member and a pair of parallel side panel members. The top panel member has a smooth, flat inner face which is adapted to engage the topmost surface of the newly laid block or brick wall. The parallel side panel members are springy and angled inwardly so that they engage the newly laid block or brick wall and have lower ends which angle outwardly to form a water deflector and guideway for installing the protection device on the newly laid block or brick wall. The top panel member is provided with a plurality of spaced rebar punchouts. One end of the channel element is provided with guide lines for adapting the ends to cover corners and other wall angulations.

6 Claims, 4 Drawing Sheets

FIG. 12
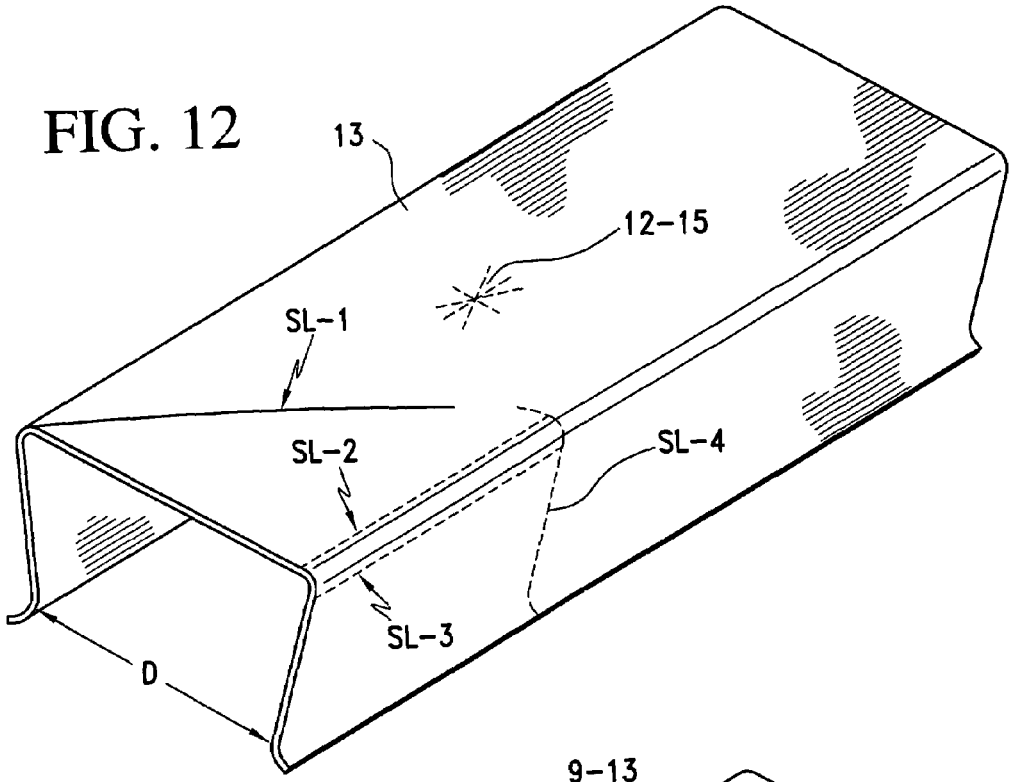
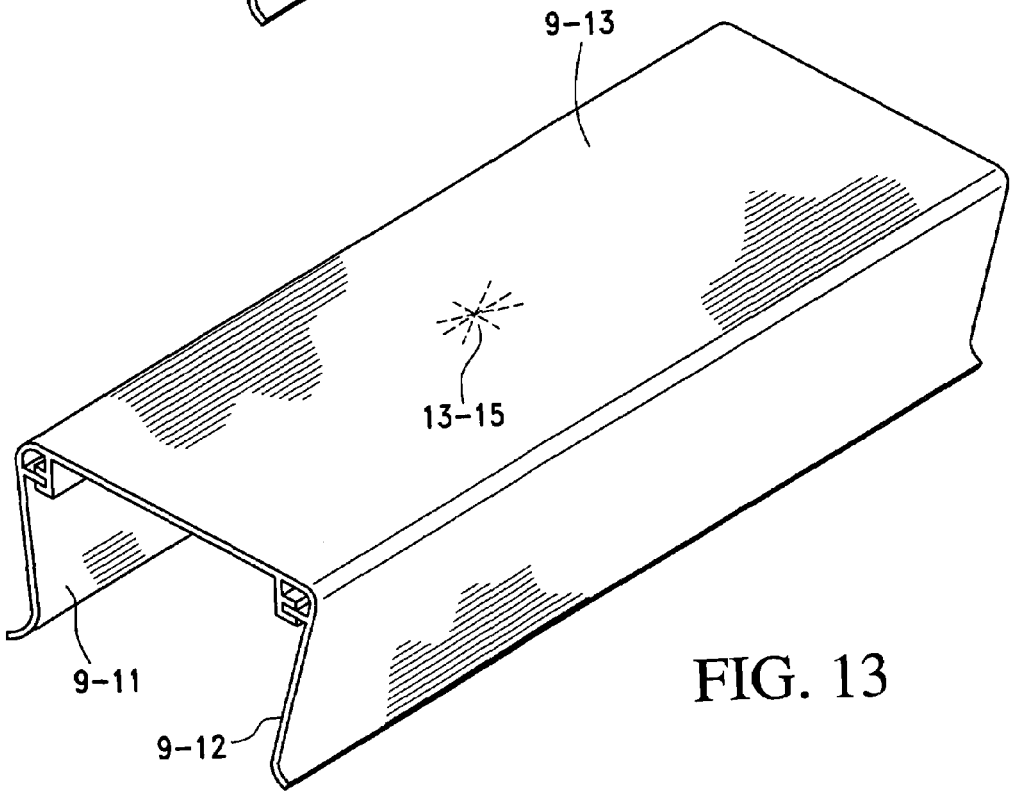
FIG. 13

FRESH MASONRY WALL PROTECTION DEVICE AND METHOD FOR RAPIDLY PROTECTING A NEWLY LAID MASONRY WALL

REFERENCE TO RELATED APPLICATION

This invention is the subject of provisional application Ser. No. 60/271,536 filed Feb. 27, 2001 entitled FRESH MASONRY WALL PROTECTOR.

BACKGROUND AND BRIEF DESCRIPTION OF THE INVENTION

There is an ongoing problem at every masonry job site for every building: at the end of the work day or before a rain storm, covering up masonry walls to prevent water from getting into the cores of the block which will potentially cause freezing and cracking of the masonry walls. Currently, plastic sheeting such as 6 mil poly is being used. The roll plastic is cut into strips and is simply secured by laying a loose concrete masonry unit (cmu) on the plastic. It is a cheap material and an accepted practice. However, in today's marketplace, labor costs are high, and furthermore, sheet plastic is not the perfect solution.

By specification, the sheet plastic is supposed to be draped 24" on each side of the cmu wall. This creates an umbrella effect when the wind blows, sometimes even lifting a 60 lb. block of the wall. The plastic rips and tears and blows off the walls and then becomes a cleanup issue, especially where projecting rebar or conduit has to penetrate the plastic. As can be imagined, it is an ongoing battle to keep walls covered.

What normally takes a complete masonry crew (blocklayers and laborers) ten to fifteen minutes each day could now be accomplished, using the present invention, with a couple of laborers, and at the same time providing better protection and allowing the blocklayers to continue working during that time; thus, a cost savings plus yielding more production. Thus, with the continuous wall protector disclosed herein, two low-cost laborers could do a better job in much less time. Plus, the wall protector system of this invention is more effective, is reusable and could be easily stored, still secure the cap with loose blocks, but would eliminate the umbrella effect. This would be a more rigid system and due to its snug fit, it would not need to extend over the walls 24" like sheet plastic. Moreover, puddling on top of the plastic would be eliminated.

According to the invention, a U-shaped wall cap or channel having wall gripping legs and spaced punchouts with pull tabs protect the newly laid wall. Because the side panel members or legs effectively "hug" the upper wall sides, the effects of wind forces, tending to lift the device from a newly laid wall, are significantly diminished or eliminated. Since the wall cap extends over many block joints, it serves as temporary reinforcement for the topmost blocks. The legs are springy and angled inwardly so they grip the newly laid wall. The wall cap has punchouts with pull tabs at periodic intervals to accommodate wall reinforcing rebars and thereby, at the same time, enhance the maintenance of the device on the wall. The rebar punchouts can be a series of star-burst score lines which are relatively easy to punch through.

In addition to protecting the masonry, another issue to consider is cold weather. Masonry cannot be laid below certain temperatures, and these temperatures must be maintained or be rising for a period of time, which is determined by that day's working temperature. Cold weather masonry is a schedule-buster and can potentially shut jobs down. The temperature may be within range during the day, but drops into the night. This prevents any walls to be laid without enclosures or other expensive means. In the past, builders ran an electric wire with pigtails and 100 watt light bulbs dropped down in the cores and covered with plastic to heat the walls during the night to avoid freezing and project shutdowns.

According to a feature of the invention, inside the wall caps disclosed herein are optionally provided with an insulating material (NFPA approved/UL rated) with a continuous electrical feed is provided. Plug and socket structures similar to that of some canister vacuum sweepers with extension attachments with male plug and female socket ends. Incorporating pigtail drops to install 100 wall bulbs evenly spaced to cmu core increments (8", 16", 24", etc. and metric equivalents). Guards can be provided to protect the bulbs similar to a trouble light. Obviously, this system would have limited use as the temperature drops but would prove very beneficial in a given temperature median.

The preferably resilient plastic materials used in making the fresh masonry wall protector disclosed herein are relatively inexpensive and may be readily molded, extruded, vacuum-formed, thermoformed, etc.

Thus, the object of the invention is to provide a fresh masonry wall protector which is easy to use, relatively inexpensive, and which can be reused time and time again.

Further objects of the invention include:

The provision of a fresh masonry protection device for rapidly protecting a newly laid block or brick wall from inclement weather comprising: an extruded channel member having a top panel member and a pair of parallel sideband members. The top panel member has a smooth, flat inner face which is adapted to engage the topmost surface of said newly laid block or brick wall. The parallel side panel members being springy and angled inwardly so that they engage the newly laid block or brick wall with sufficient force so as to prevent wind forces from lifting the temporary wall cap off of the wall and yet it is easily removable when work on the wall is resumed. The top panel member has scored punchouts or frangible portions for rebar at predetermined intervals along the length of the top panel member.

The fresh masonry protection device as described above wherein the top panel member optionally includes a pair of electrical wires for supplying electrical energy to heating elements or light bulbs at spaced intervals along the length of the freshly laid wall.

The fresh masonry wall protection device described above wherein the top panel member is wider than the width of the newly laid block or brick wall and the side panels are angled inwardly to snuggly fit the upper side edges of said newly laid block or brick wall but is easily removable for storage and reuse at the end of a workday. In a preferred embodiment, the lower edge of the side panels deflect or curve outwardly, thereby forming an application guideway, facilitating the application of the device to a wall and at the same time, the lower edge forms a water deflector or gutter.

A further object of the invention is to provide a method for rapidly protecting a newly laid block or brick wall from inclement weather comprising: (a) providing an extruded channel member having a top panel member and a pair of parallel side panel members, the top panel member having a smooth, flat inner face which is adapted to engage the topmost surface of a newly laid block or brick wall, the parallel side panel members being resilient, springy and angled inwardly so that they simultaneously engage the newly laid block or brick wall when in place on the wall and have angled ends forming a guideway for receiving the top of the newly laid block or brick wall, (b) engaging the sides of the wall adjacent the top with one end of the guideway and expanding the distance between the engaging side panel members by the width of the wall and (c) then pivoting the channel member about the point of engagement of the side panel members with the wall in a generally downward direction to seat one end of the channel member on the wall, and essentially align the channel member with the wall, and (d) then seating the remainder of the channel member on the top of the wall by progressively pressing downwardly on the top panel member beginning at the one end.

BRIEF DESCRIPTION OF THE DRAWINGS

The above and other objects, advantages and features of the invention will become more apparent when considered with the following specification and accompanying drawings wherein:

FIG. 12 is a perspective view showing a further embodiment of the invention and how the ends are provided with break-aways or score lines so that the invention can be applied easily to corners, and FIG. 13 is a perspective view of the embodiment shown in FIG. 6 showing the FIG. 3A embodiment of the rebar punch-outs.

DETAILED DESCRIPTION OF THE INVENTION

Figure 1A:
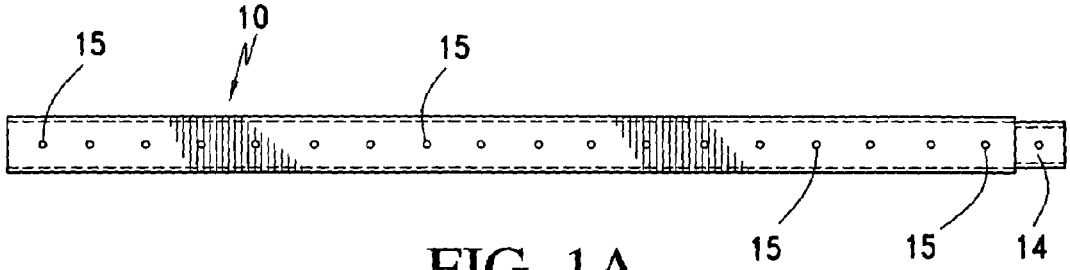
FIGS. 1A and 1B are top plan views of a fresh masonry protection device for rapidly protecting a newly laid block or brick wall incorporating the invention.
Figure 1B:
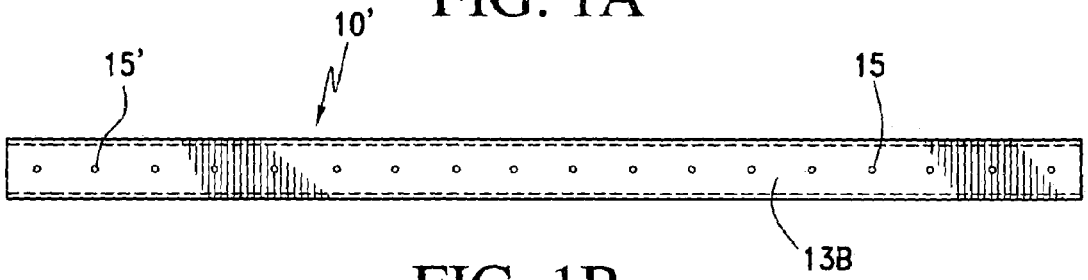
Figure 2A:
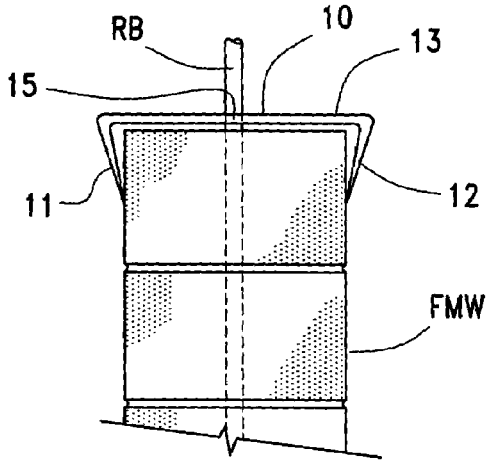
FIGS. 2A and 2B are cross-sectional views showing the fresh masonry protection device on a freshly laid masonry wall.
Figure 2B:
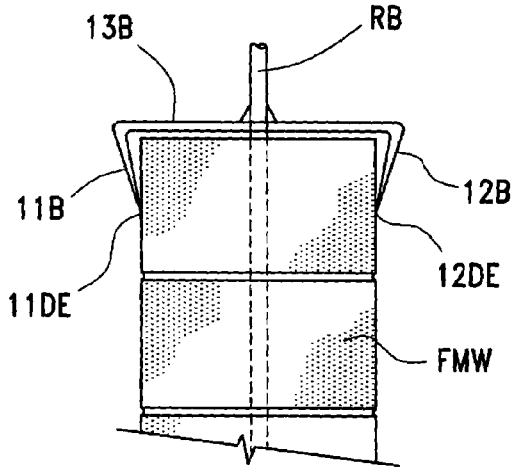

Referring now to FIG. 1, the newly laid block or brick wall protector 10 of the present invention is made in various widths, such as four-inch, six-inch, eight-inch, twelve-inch, fourteen-inch widths, to accommodate the various widths of the wall; and as shown in FIG. 2, the width of top panel 13 is slightly larger than the width of the wall FMW to allow the side panels to taper inwardly. The wall protector 10 can be made in standard lengths of eight-foot, twelve-foot, sixteen-foot and twenty-foot, etc. increments. The wall protector 10 includes a pair of side panels 11 and 12 joined by a top panel member 13 as shown in FIG. 2A that the sides 11 and 12 are angled inwardly and beveled to a feathertip for a tight fit. As shown in FIG. 1A, the ends 14 can be optionally tapered for a slip joint so that the succeeding wall protector on a long wall can be snuggly fitted and joined over the end of the wall protector 10.

Figure 3A:
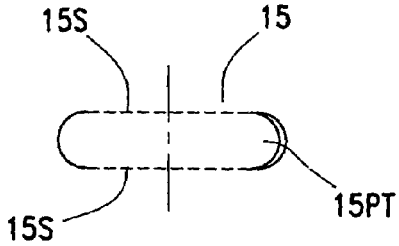
FIG. 3A is a top plan view of a slotted punchout for rebar.

The top panel 13 is provided with a plurality of punchouts 15 for rebars RB. The punchouts 15 in the embodiment shown in FIG. 3A are slotted as at 15S and provided with a pull tab 15PT and have a length of approximately three inches to accommodate the leeway of placement of the rebar in the wall. While the punchouts are at eight-inch increments, it will be appreciated that there can be other increments as well.

Figure 3B:
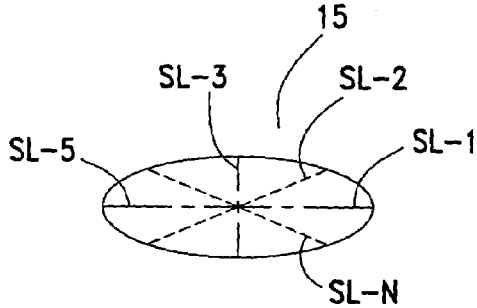
FIG. 3B is a top plan view of a preferred embodiment of the rebar punchout.

In the embodiment shown in FIG. 1B, the side panels 11B, 12B are provided with a short extension forming a drip edge. These extensions 11DE and 12DE form an installation guideway and tend to divert water from the wall. By adding the guideway/drip edges 11DE and 12DE, the inside curve of the flange and directs and guides downward placement onto the wall. The drip edges 11DE and 12DE are wider than the width of the fresh masonry wall FMW so that the wall protector can be easily positioned simply by placing it on the top of the wall and pressing downwardly. Thus, the installation involves engaging the sides of the wall adjacent the top with one end of the guideway and expanding the distance between the engaging side panels members by the width of the wall and then pivoting the channel member about the point of engagement of the side panel members with the wall in a generally downward direction to seat one end of the channel member on the wall, and essentially align the channel member with the walls, and then seating the remainder of the channel member on the top of the wall by progressively pressing downwardly on the top panel member beginning at the one end. The process is repeated in overlapping relation for the entire length of the wall. This avoids placing the lateral pressure on the freshly laid masonry courses. At corners, the ends shown in FIG. 12 may be used. Referring now to FIG. 3B, an alternative embodiment of the rebar punchouts is disclosed. In this embodiment, instead of a pull tab, scoreline/slits are at the punchout increments as before in connection with the pull tab embodiment. In this embodiment, the punchouts are simply score lines SL-1, SL-2, SL-3 . . . SL-N so that the rebar elements (or workman) simply press out much in the same fashion as a straw does in a plastic lid on drink cups. The punchouts, however, unlike the straw punchouts for a drinking cup, are score lines or slits shown in FIG. 3B which are elongated along the long dimension of the wall protector 10 and may be formed by water jets and the like. Similar to the punchouts shown in FIG. 3A, the length of the punchouts with the score lines shown in FIG. 3B is approximately three inches, more or less, so as to accommodate misplacements in the rebar.

The punchout shown in FIG. 3B is made through a waterjet process in the form of an asterical which is scribed to allow the rebars to punch through. This is similar to a straw through a lid concept but in reverse. Also, this feature will be more accommodating to different size rebars and oversized for position tolerances. This should not allow as much water into the cores as well. With regards to placement, since they are on eight-inch increment spacing, a laborer can determine the spacing of the rebars and prepunch according to the actual placement. Since the wall protector of this invention will be more snuggly fit on the top of the wall, wind and other natural forces of nature will not be able to place much force on the wall protector, thereby keeping the water out of the cores.

Figure 4:
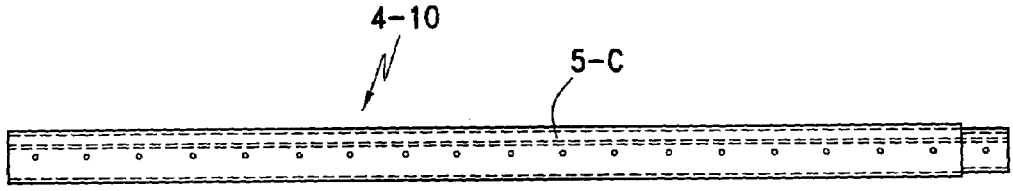
FIG. 4 is a modification showing the incorporation of a pair of electrical wires for supplying heat lamps.
Figure 6:
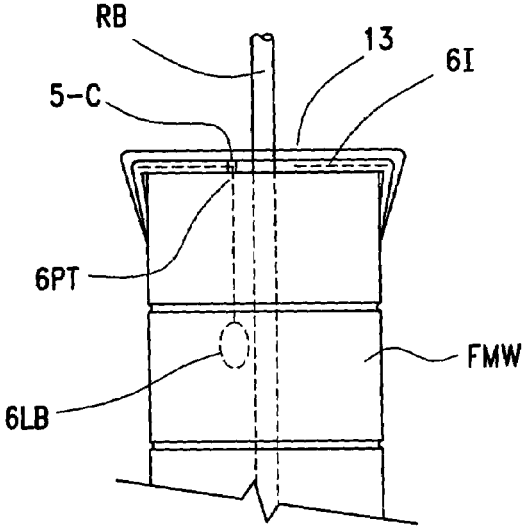
FIG. 6 is a sectional view showing the embodiment shown in FIG. 4 with a heating light bulb connected thereto.
Figure 5:
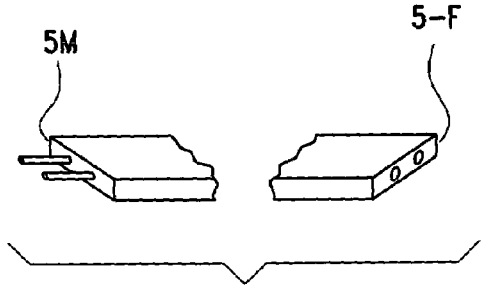
FIG. 5 is a view showing the male and female socket ends of the heating wire.
Figure 7:
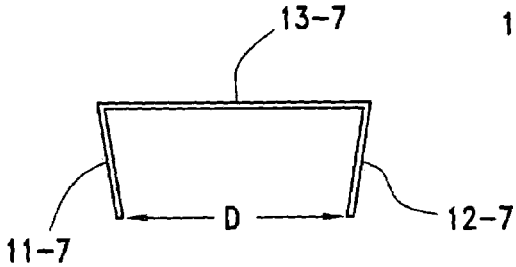
FIG. 7 is a sectional view of a further embodiment of the invention.
Figure 8:
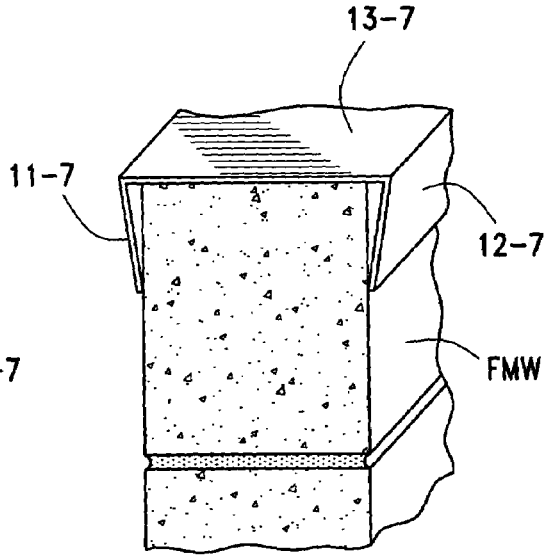
FIG. 8 is a sectional view of the FIG. 7 embodiment as it is applied to a freshly laid block or brick wall.
Figure 9:
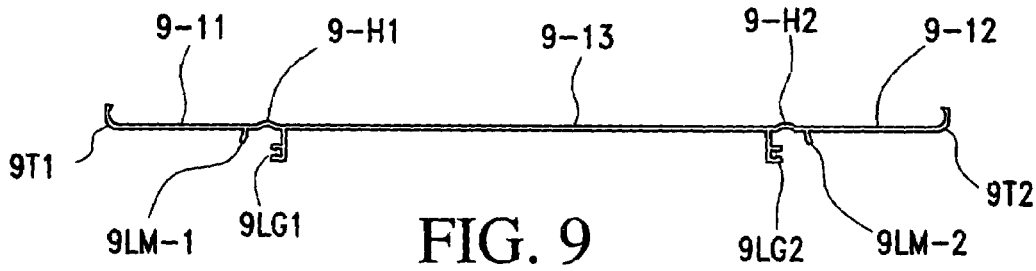
FIG. 9 is a sectional view of a further embodiment of the invention employing living hinges and latches.
Figure 10:
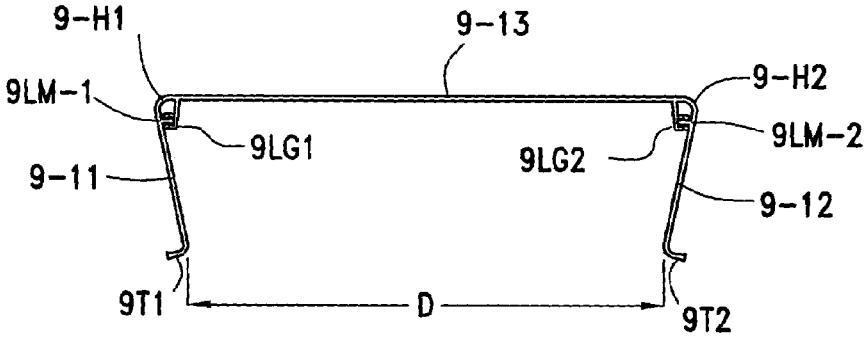
FIG. 10 is a sectional view showing the embodiment shown in FIG. 9 in an assembled state with the latches in operation.

Referring now to FIG. 4, the wall protector 4-10 is similar to the wall protector shown in FIG. 1, except, in this case, the wall protector 4-10 is provided with a pair of insulated electrical wires for supplying electrical energy to heating elements or light bulbs at spaced intervals along the length of the freshly laid walls. In this embodiment, the electrical wires are embedded in a plastic strip (see FIG. 5) which has male and female end fitments 5-M and 5-F which operate much in the fashion of the plugging in of an electrical hose attachment for the handle of a vacuum clean and the like. The electrical wire carrier 5-C can be provided with pigtails 6PT to which may be connected light bulbs or heating elements 6LB as shown in FIG. 6. Insulation 6I may also be included on the inner surface of the wall protector top panel 13 (see FIG. 6).

Referring now to FIGS. 9, 10, 11 and 13, in this embodiment of the invention, the top panels 9-13 and side panels 9-11 and 9-12 are extruded flat or in a common plane and joined to each other by living hinges 9-Hi, 9-H2. The living hinge is a technique for marrying flexible PVC with more rigid PVC and is known in the plastic extrusion arts.

To maintain the wall protector in a U-shaped configuration, adjacent each living hinge 9-H1 and 9-H2 are provided latching or locking arrangements. In this disclosed embodiment, the locking or latching structures include a latching groove 9LG1 and 9LG2 and cooperating latching member 9LM-1 or 9LM-2. In operation, the side panels 9-11 and 9-12 with their respective latching members 9LM-1 and 9LM-2 are folded about the living hinges 9-H1, 9-H2, respectively, to the position shown in FIG. 10, where the latching members 9LM-1 and 9LM-2 are pressed into the locking grooves 9LG-1 and 9LG-2. Then the distance D between the innermost edges of the side panels 9-11 and 9-12 is less than the width W of the freshly laid masonry walls FMW. The tips 9T1 and 9T2 of side panels 9-11 and 9-12 curve outwardly forming a mouth with guide edges 9T1 and 9T2 which enable the upper edges of the wall 9W to fit within the boundaries of the tips 9T1 and 9T2 to slightly spread the side panels 9-11, 9-12 apart against the springiness of the material of which they are made. This allows them to snuggly engage the sides of the wall 9W and thereby retain the wall cover in place. This, of course, will be augmented in the situation where rebar is used on the wall, and it can be assisted by laying a brick or block or two on top of the top panel member 9-13.

Referring now to FIGS. 12 and 13, in FIG. 12, the end of the channel member is illustrated as having score lines SL-1, SL-2, SL-3 . . . SL-N at various angles and permutations. The purpose of this is to enable the materials to be severed at the angles illustrated so as to form corners and joints. The material is thin enough that it can be cut with a pair of scissors along the lines as shown. For example, it can be cut along lines SL-1 and SL-4 to form a 90° angle with a similar channel member cut along corresponding lines. Alternatively, the material can be cut or separated along lines SL-3 or SL-2 and SL-4 and then overlapped with a correspondingly similar cut on the other angle.

Figure 11:
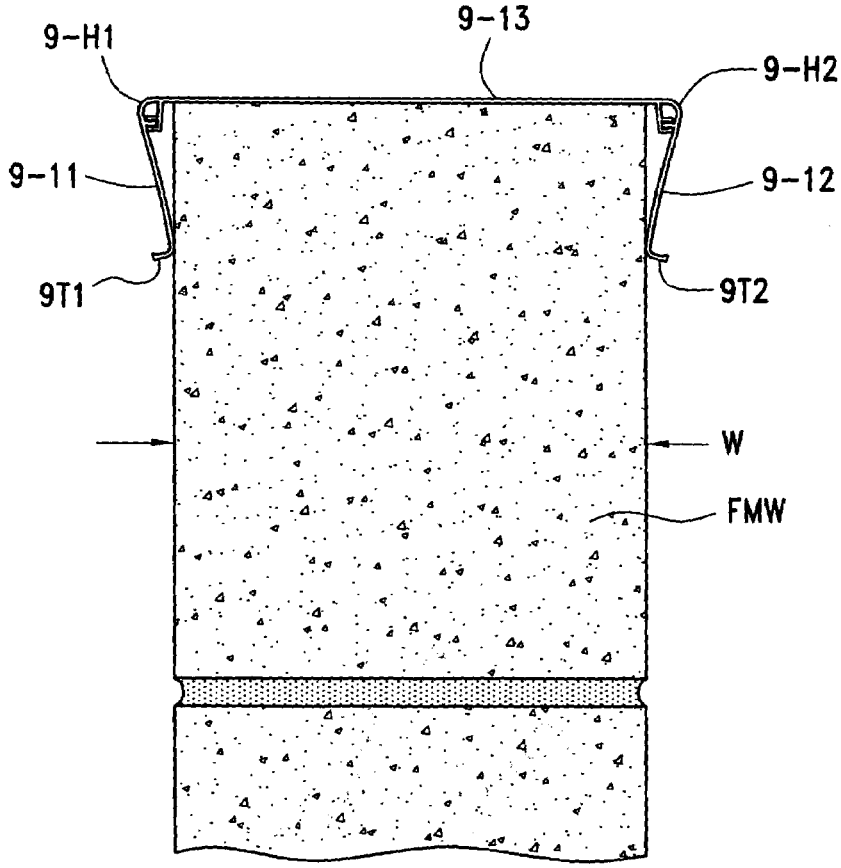
FIG. 11 is a sectional view of a freshly laid block or brick wall to which the invention has been applied.

In FIG. 13, a section of the embodiment illustrated in FIG. 11 is shown with a star-type rebar pushthrough 13-15.

While the invention has been described in relation to preferred embodiments of the invention, it will be appreciated that other embodiments, adaptations and modifications of the invention will be apparent to those skilled in the art.

What is claimed is:

1. A fresh masonry protection device for rapidly protecting a newly laid block or brick wall from inclement weather comprising:

an extruded channel device having a top panel member and a pair of parallel side panel members, said top panel member having a smooth, flat inner face which is adapted to engage the topmost surface of said newly laid block or brick wall, said parallel side panel members being resilient and springy and angled inwardly so that they grip the newly laid block or brick wall, said top panel member having a plurality of punchouts for rebar at predetermined intervals along the length of said top panel member.

2. The fresh masonry protection device defined in claim 1 wherein said top panel member includes a pair of insulated electrical wires for supplying electrical energy to heating elements or light bulbs at spaced intervals along the length of said freshly laid wall.

3. The fresh masonry wall protection device defined in claim 1 wherein said top panel member is wider than the width of said newly laid block or brick wall and said side panels have ends that are angled outwardly to form guideways for installing said protection device onto said newly laid block or brick wall.

4. A fresh masonry protection device for rapidly protecting a newly laid block or brick wall from inclement weather comprising:

a channel element having a top panel member and a pair of parallel side panel members, said top panel member having a smooth, flat inner face which is adapted to engage the topmost surface of said newly laid block or brick wall, said parallel side panel members being springy and angled inwardly so that they grip the newly laid block or brick wall, said side panel members having tip ends which are angled outwardly to form an installation guideway, said top panel member having punchouts for rebar at predetermined intervals along the length of said top panel member.

5. The fresh masonry wall protection device defined in claim 4 wherein said top panel member includes a pair of insulated electrical wires for supplying electrical energy to heating elements or light bulbs at spaced intervals along the length of said freshly laid wall.

6. The fresh masonry wall protection device defined in claim 4 wherein said top panel member is wider than the width of said newly laid block or brick wall and said side panels have ends that are angled outwardly to form guideways for installing said protection device onto said newly laid block or brick wall.

* * * * *